US005685471A

United States Patent [19]

Taubenberger

[11] Patent Number: 5,685,471

[45] Date of Patent: Nov. 11, 1997

[54] PRINTING DEVICE WITH FRICTION DRIVE FOR PROCESSING STRIP-SHAPED RECORDING SUBSTRATES

[75] Inventor: Hans Taubenberger, Gmund, Germany

[73] Assignee: Oce Printing Systems GmbH, Poing, Germany

[21] Appl. No.: 663,079

[22] PCT Filed: Sep. 15, 1994

[86] PCT No.: PCT/DE94/01067

§ 371 Date: Jun. 25, 1996

§ 102(e) Date: Jun. 25, 1996

[87] PCT Pub. No.: WO95/19929

PCT Pub. Date: Jul. 27, 1995

[30] Foreign Application Priority Data

Jan. 24, 1994 [DE] Germany ..... 44 01 906.8

[51] Int. Cl.[6] ..... B65H 26/00; B65H 23/18; B65H 23/04; B65H 57/28

[52] U.S. Cl. ..... 226/17; 226/39; 226/195; 226/196; 242/615.1; 242/615.3

[58] Field of Search ..... 226/15, 17, 39, 226/44, 195, 196

[56] References Cited

U.S. PATENT DOCUMENTS

| | | | |
|---|---|---|---|
| 3,231,668 | 1/1966 | Nishiwaki et al. | 226/195 X |
| 3,384,281 | 5/1968 | Mason | 226/39 X |
| 3,540,674 | 11/1970 | Okamura . | |
| 4,129,238 | 12/1978 | Herd . | |
| 4,173,301 | 11/1979 | Turini et al. | 226/195 X |
| 4,592,669 | 6/1986 | Lohse et al. . | |
| 4,603,800 | 8/1986 | Focke et al. | 226/195 X |
| 4,609,279 | 9/1986 | Hausmann et al. . | |
| 4,611,799 | 9/1986 | Nuttin . | |
| 4,919,318 | 4/1990 | Wong . | |
| 4,982,946 | 1/1991 | Uchimura et al. . | |
| 5,010,816 | 4/1991 | Sarda . | |
| 5,106,007 | 4/1992 | Lyga | 242/615.1 X |
| 5,310,107 | 5/1994 | Todd et al. | 226/196 |

FOREIGN PATENT DOCUMENTS

| | | |
|---|---|---|
| 0 150 360 | 8/1985 | European Pat. Off. . |
| 0 180 769 | 5/1986 | European Pat. Off. . |
| 0 154 695 | 6/1988 | European Pat. Off. . |
| 0 317 396 | 5/1989 | European Pat. Off. . |
| 0 383 496 | 8/1990 | European Pat. Off. . |
| 2 364 839 | 4/1978 | France . |
| 19 37 699 | 2/1971 | Germany . |
| 17 61 432 | 1/1975 | Germany . |
| 27 21 003 | 11/1977 | Germany . |
| 28 48 134 | 10/1979 | Germany . |
| 36 04 915 | 8/1986 | Germany . |
| 9218167 | 10/1993 | Germany . |
| WO 90/11894 | 10/1990 | WIPO . |

*Primary Examiner*—Michael Mansen
*Attorney, Agent, or Firm*—Hill, Steadman & Simpson

[57] ABSTRACT

A printing device with friction drive for processing continuous paper. For this purpose, it contains a friction drive (8) comprising friction rollers, between which the recording substrate (A) is passed through, and a paper feed device (PZ). In the paper feed device (PZ), the recording substrate (A) is aligned in a web precentering device (3), is thereafter braked in the recording substrate transport direction, so that the recording substrate (A) assumes a predetermined position in the friction drive (8). After that, the recording substrate web is stabilized in a stabilization zone by stabilization rollers (9) and is fed via a festoon device (10) to the drive (8) of the printing unit (DA).

11 Claims, 1 Drawing Sheet

PRINTING DEVICE WITH FRICTION DRIVE FOR PROCESSING STRIP-SHAPED RECORDING SUBSTRATES

BACKGROUND OF THE INVENTION

The present invention generally relates to printers for continuous paper, such as that supplied in a roll or an alternatingly folded stack. More particularly, the present invention relates to a drive and paper positioning system in such a printer.

Electrophotographic printing units which operate with continuous paper, such as are known, for example, from the European Patent Application 0 154 695, can print both reeled papers and stacked goods. They are fed, for paper guidance, with transport caterpillar tracks which engage in a correspondingly perforated auxiliary strip at the edge of the paper (Remaliner).

The printing of fanfold paper with perforations arranged at the side is technically sophisticated and well-proven. However, it is disadvantageous that papers in each case have to be custom made, an additional paper component for the perforated strips has to be paid for at the time of supply and, in addition, this strip as a rule has to be cut away again during post-processing and disposed of. From this, distinctly increased costs arise for the user in connection with the perforated transport strip.

In paper post-processing technology, web guides which are free of transport holes are known which, mostly in conjunction with active control units (rotary frames) and perforated reeled products, transport exactly with very high tensions. This transport is, for example, necessary if the edge strip is removed directly after leaving the printing device, In the case of data printers processing continuous paper, it is generally necessary to guide the paper web exactly, both with respect to its speed and also with respect to the lateral position, and to synchronize it with the printing unit in such a way that the necessary register accuracy between printed image and paper is achieved.

For this reason, it has previously been common, for electrophotographic printing devices which operate with continuous paper, to use paper webs which have side perforations.

For the reasons described, however, this severely limits the usefulness of the electrophotographic printing device severely.

If, in printing devices of this type, a friction drive is used as paper drive, as is used, for example, in the paper post-processing technology described, there is a risk that, in the use of fanfold paper, the perforation will tear at the transverse perforations of the printed pages. On the other hand, it is necessary to configure the data printers which process continuous paper in such a way that they cope both with perforated and unperforated paper and with perforated and unperforated stacked products.

It is therefore the object of the invention to provide a printing device for processing strip-shaped recording substrates in which printing device the strip-shaped recording substrate is driven with friction. The printing device in this arrangement is intended to be able to process perforated and also unperforated paper. It is a further aim of the invention to provide for the printing device paper guidance for the strip-shaped recording substrate which is suitable for synchronizing both reeled paper and also stacked products with the printing unit to the required accuracy, without transport holes being necessary as guide for this purpose.

SUMMARY OF THE INVENTION

The aforementioned objects are achieved by the present invention which, in an embodiment, provides a printing device, such as an electrographic or magnetographic printing device, for processing a strip-shaped recording substrate, such as the type of substrate supplied in a roll or an alternately-folded stack. This printing device includes a friction drive for transporting the strip-shaped recording substrate and a paper feed device for feeding the strip-shaped recording substrate to the friction drive. The paper feed device has:

- a web precentering device operable to align the strip-shaped recording substrate by forcible guidance on an aligning edge;
- a device operable to increase the tension in the strip-shaped recording substrate in a recording substrate transport direction past the web precentering device in such a manner that the strip-shaped recording substrate assumes a predetermined position in the friction drive;
- a web stabilization device stabilizing the recording substrate run in a stabilization zone positioned before the friction drive; and
- a mechanical strip accumulator for accumulating the recording substrate, such as to form the substrate into festoons.

In an embodiment, the web precentering device includes friction rollers located in frictional contact with the recording substrate and which are aligned obliquely relative to the recording substrate transport direction.

The tension-increasing device includes a brake which brakes the recording substrate uniformly over its width. This brake may be a vacuum brake.

In an embodiment, the web stabilization device includes a plurality of stabilization rollers around which the recording substrate is wrapped around. These stabilization rollers may, if needed, have a friction-increasing slip-resistant surface.

In an embodiment, the printing device further includes a paper separator device, which is positioned before the paper feed device and which has two parallel deflection axles between which the recording substrate may be passed so that the recording substrate is wrappable around the deflection axles.

The printing device may also be provided with a friction drive having friction rolls between which the recording substrate is passed through in a slip-resistant manner to minimize slippage.

The present invention also provides a method for feeding the strip-shaped recording substrate to a printing device which has a friction drive for transporting the strip-shaped recording substrate. This method includes the following steps:

- aligning the strip-shaped recording substrate by forcible guidance on an aligning edge of a web precentering device;
- braking the strip-shaped recording substrate in the recording substrate transport direction after the web precentering device in such a manner that the strip-shaped recording substrate assumes a predetermined position in the friction drive; and
- stabilizing the recording substrate run in a stabilization zone positioned before the friction drive.

The printing device according to the invention enables the processing of perforated and unperforated paper with high positional accuracy. The risk of tearing occurring with the use of perforated paper is significantly reduced. The device according to the invention is particularly suitable for use by document printing devices, in which strip-shaped recording substrates cut into individual sheets are individualized and combined to form documents.

Additional features and advantages of the present invention are described in, and will be apparent from, the detailed description of the presently preferred embodiments and from the drawings.

BRIEF DESCRIPTION OF THE DRAWINGS

An embodiment of the invention is shown in the drawings and is described in more detail by way of example in the following.

DETAILED DESCRIPTION OF THE PRESENTLY PREFERRED EMBODIMENTS

Figure 1:
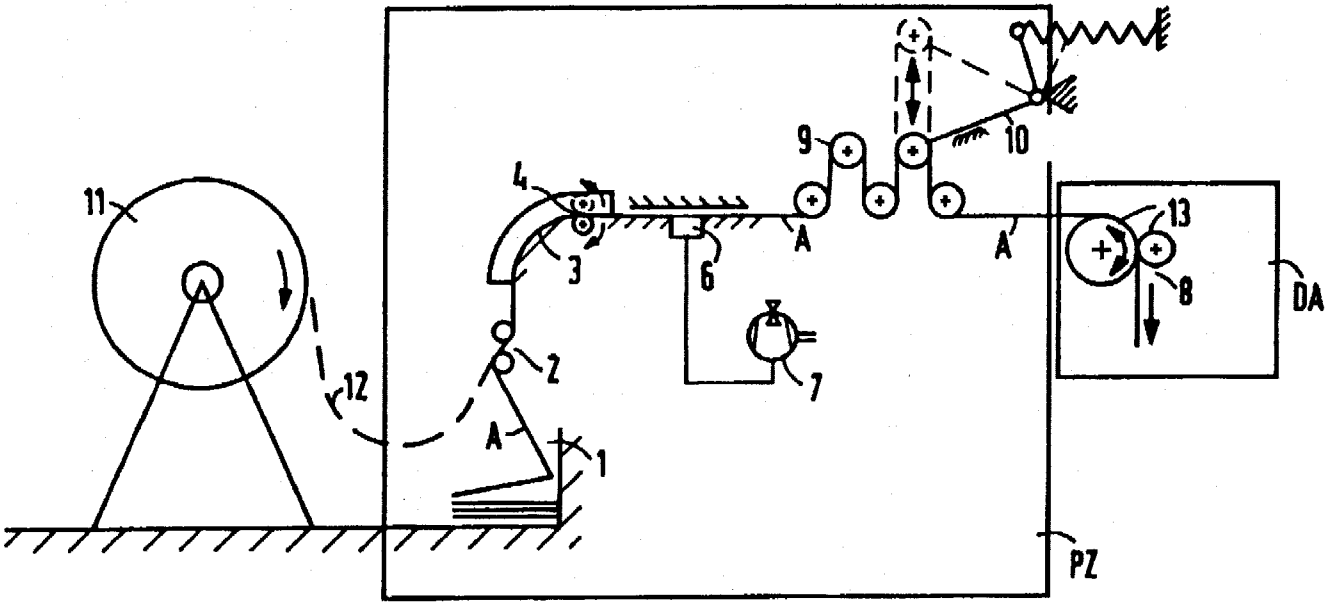
FIG. 1 is a schematic view of a printing device with friction drive for processing continuous paper and FIG. 2 is a schematic view of a web precentering device with obliquely set friction rollers.

The printing device, shown in the figures, with a friction drive for processing strip-shaped recording substrates A has a dedicated printing unit DA which, for example, can be designed in accordance with the European Patent Application 0 154 695, and a paper feed device PZ. The printing unit DA is designed for processing strip-shaped recording substrates A which are configured as reeled products or as stacked products. It has a friction drive comprising two friction rolls, between which the recording substrate is fed through. The strip-shaped recording substrate A is fed via a paper feed device PZ, specifically in the following manner. In a paper input device 1, the continuous paper, which custom made as prefolded fanfold paper, but has no side transport holes, is first deflected or braked without significant web tension over two parallel deflection axles of fixed axles 2 (paper separator). The fixed axles 2 operate both as a light brake and also as paper separator in order, for example, to separate web layers which are carried along from one another. In a web precentering device 3, the paper web is deflected (about 90° ) and, with the aid of two obliquely set friction rollers 4 which are located in frictional contact with the recording substrate A (FIG. 2), are pushed against a left-hand stop or web limiting device 5 in the form of a stop. The position of the paper web or of the recording substrate A is thus determined by the contact of the web edge on the left-hand web limiting device of the paper channel of the paper feed device. However, it is also possible to use the right-hand web limiting device by means of a corresponding arrangement of the rollers 4.

Figure 2:
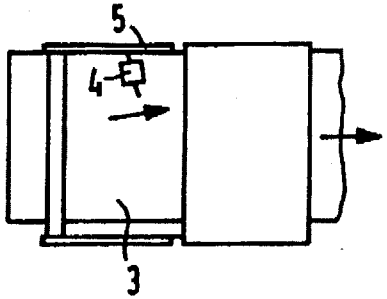

After the web precentering via the web precentering device of FIG. 2, the tension in the paper web A is increased by means of a web brake. In this arrangement it is important that the paper web A is braked only in the transport direction and not obliquely or asymmetrically. This can be carried out, for example, by means of a vacuumbrake 6 with associated vacuumpump 7. As a result of the tension, the paper web A is aligned in the drive 8 and seeks a central position. The drive of the paper guide 8 is designed as friction drive with the least possible slip or frictional value which remains constant for the lifetime, for this purpose it contains two friction rollers 13, between which the recording substrate is fed through.

The higher the tension, the lower are the sideways swinging movements of the web A and vice versa. This relationship is also true for the evenness of the paper web A.

Deflection rollers 9 arranged downstream of the vacuum brake 6 form a stabilization zone into which the paper course of the paper web A is stabilized. Drift influences on the drive side on the paper web or on the contact of the paper web on the web limiting device 5 in the web precentring device 3 are strongly reduced as a result. The effect of the stabilization rollers 9 is particularly effective in the case of the greatest possible wraparound (large contact areas) and with driving covers on the rollers.

In the stabilization zone, there is arranged a mechanical web accummulator in the form of a festoon device 10, having two fixed and one oscillating roller which is moved counter to a spring. The festoon device holds the paper web A under tension in the case of reverse transport caused by start-stop. It prevents tearing of the recording substrate. The tension in the paper web A for this case lies somewhat below the otherwise common tension and is approximately constant over the entire working range of the festoon device, as far as to the stop. After passing through the festoon device, the paper web A is fed to the friction drive 8 of the printing unit DA.

If the printing device is operated with reeled paper which is drawn off from a reel 11, it is favorable to drive or to brake the reel 11 separately, as shown. The drive of the reel 11 or of its brake is controlled such that a defined loop 12 is formed between reel 11 and paper entry 1, the loop serving as mechanical paper accumulator. Pulling into the web precentering device 3 thus takes place under conditions which are similar to those in the case of operating the paper input 1 with continuous paper stacks. In summary, the guidance of continuous paper can be functionally subdivided into the following steps: paper input via reel or stacks with subsequent web precentering by means of side paper contact in a web precentering device. Increase of the tension with the aid of a web brake. Stabilization of the recording substrate web in a web stabilizing unit with directed retroaction. Passage through a festoon device, in order to prevent tearing of the recording substrate web in start-stop operation and transport of the recording substrate web through the printing device in a friction drive.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A printing device for processing strip-shaped recording substrates, the printing device having a friction drive for transporting the strip-shaped recording substrate and a paper feed device for feeding the strip-shaped recording substrate to the friction drive, the paper feed device comprising:

a web precentering device operable to align the strip-shaped recording substrate by forcible guidance on an aligning edge;

a device operable to increase the tension in the strip-shaped recording substrate in a recording substrate transport direction past the web precentering device in such a manner that the strip-shaped recording substrate assumes a predetermined position in the friction drive;

a web stabilization device stabilizing the recording substrate run in a stabilization zone positioned before the friction drive; and a mechanical strip accumulator for accumulating the recording substrate.

2. The printing device as claimed in claim 1, wherein the web precentering device includes friction rollers which are located in frictional contact with the recording substrate and which are aligned obliquely relative to the recording substrate transport direction.

3. The printing device as claimed in claim 1, wherein the tension increasing device includes a brake which brakes the recording substrate uniformly over its width.

4. The printing device as claimed in claim 3, wherein the brake is a vacuum brake.

5. A printing device as claimed in claim 1, wherein the web stabilization device includes a plurality of stabilization rollers around which the recording substrate is wrapped around.

6. A printing device as claimed in claim 5, wherein said stabilization rollers have a slip-resistant surface.

7. The printing device as claimed in claim 1, wherein the mechanical strip accumulator has a festoon device.

8. The printing device as claimed in claim 1, further having a paper separator device, which is positioned before the paper feed device and has two parallel deflection axles, between which the recording substrate is passable so that the recording substrate is wrappable around the deflection axles.

9. The printing device as claimed in, claim 1, further having a friction drive including friction rolls between which the recording substrate is passed through in a slip-resistant manner.

10. The printing device as claimed in claim 1, wherein the printing device is an electrographic or magnetographic printing device.

11. A method for feeding a strip-shaped recording substrate to a printing device which has a friction drive for transporting the strip-shaped recording substrate, the method comprising the following steps:

aligning the strip-shaped recording substrate by forcible guidance on an aligning edge of a web precentering device;

braking the strip-shaped recording substrate in the recording substrate transport direction after the web precentering device in such a manner that the strip-shaped recording substrate assumes a predetermined position in the friction drive;

stabilizing the recording substrate run in a stabilization zone positioned before the friction drive.

* * * * *